US006020546A

United States Patent [19]

Cohen et al.

[11] Patent Number: 6,020,546

[45] Date of Patent: Feb. 1, 2000

[54] BLOCK PERCUSSION INSTRUMENT

[75] Inventors: Martin Cohen, Montvale; Richard Simons, Garfield; Donald Kralik, Hewitt, all of N.J.

[73] Assignee: Latin Percussion, Inc., Garfield, N.J.

[21] Appl. No.: 09/096,879

[22] Filed: Jun. 12, 1998

Related U.S. Application Data

[60] Provisional application No. 60/050,911, Jun. 13, 1997.

[51] Int. Cl.[7] ..... G10D 13/08

[52] U.S. Cl. ..... 84/402; 84/410

[58] Field of Search ..... 84/402, 410, 411 R, 84/452 R, 452 P; D17/22

[56] References Cited

U.S. PATENT DOCUMENTS

| | | |
|---|---|---|
| D. 318,680 | 7/1991 | Cohen et al. . |
| 3,561,716 | 2/1971 | Thompson . |
| 4,214,504 | 7/1990 | Rex . |
| 4,898,061 | 2/1990 | Cohen et al. . |
| 5,063,821 | 11/1991 | Battle . |

*Primary Examiner*—Jeffrey Donels
*Attorney, Agent, or Firm*—Ohlandt, Greeley, Ruggiero & Perle, L.L.P.

[57] ABSTRACT

A hollow block-type percussion instrument including a body, the body having a first end, a second end, and a substantially semicircular cross-section along a length thereof between the first end and the second end.

13 Claims, 3 Drawing Sheets

BLOCK PERCUSSION INSTRUMENT

This application claims benefit of provisional application Ser. No. 60/050,911 filed Jun. 13, 1997.

FIELD OF THE INVENTION

The present invention relates to musical instruments, and more particularly to block-type percussion instruments.

BACKGROUND OF THE INVENTION

Block-type percussion instruments are known in the art. These instruments are capable of being struck or tapped by a musician, typically with drum sticks, to produce a sharp rapping sound. These instruments are typically hollow blocks of wood, often referred to as temple blocks. These idiophone percussion instruments incorporate hollow chambers into the block to alter the sound produced by the instrument.

However, these instruments can be costly to produce, and traditionally can provide only a limited range of sounds when struck. Accordingly, a need exists for a block-type percussion instrument that is simple and cost-effective to manufacture, and that provides an enhanced range of sounds when struck.

SUMMARY OF THE INVENTION

Accordingly, it is an object of the present invention to provide a block-type percussion instrument that is simple and cost-effective to manufacture.

It is another object of the present invention to provide such an instrument that provides an enhanced range of tones when struck in different locations.

It is a further object of the present invention to provide such an instrument that is easy to mount.

Accordingly, the present invention relates to a hollow block-type percussion instrument including a body, the body having a first end, a second end, and a substantially semicircular cross-section along a length thereof between the first end and the second end.

DISCUSSION OF THE PREFERRED EMBODIMENTS

Figure 1:
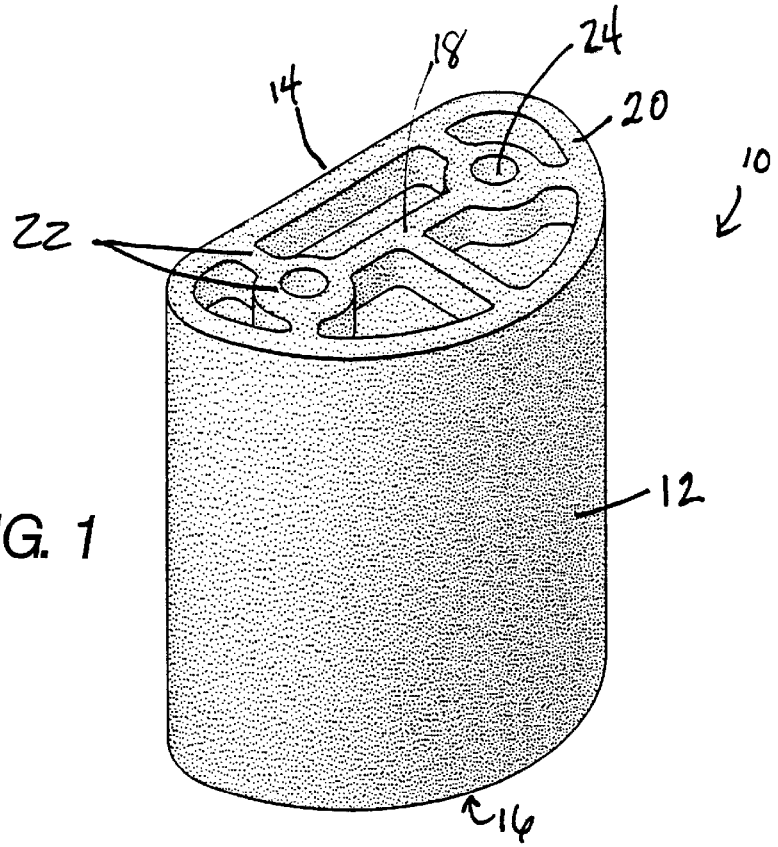
FIG. 1 is a first perspective view of a block-type percussion instrument according to the present invention.
Figure 2:
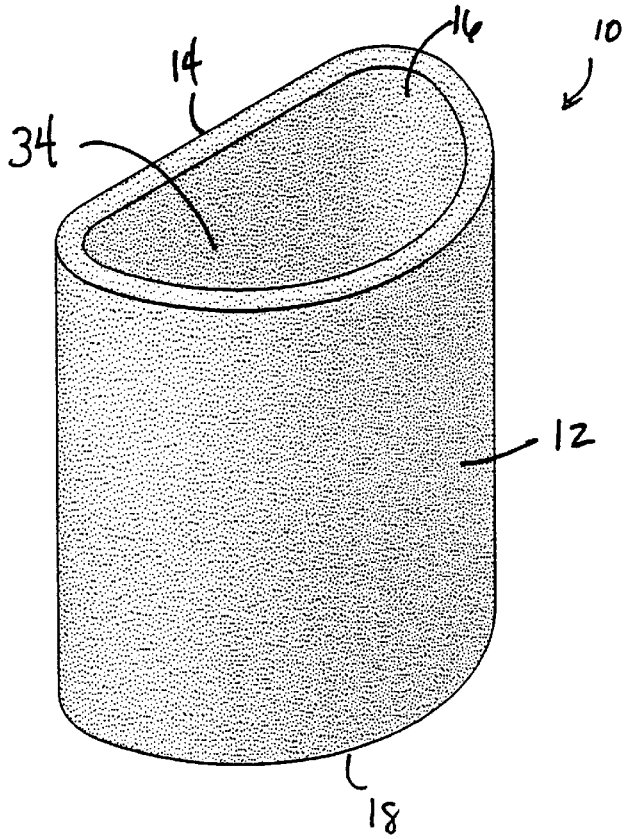
FIG. 2 is a second perspective view of the instrument of FIG. 1.

The block-type instrument of the present invention has an elegant structure that maximizes sound, volume and tone production, while minimizing production cost and providing for ease of mounting.

As shown in the figures, a preferred block instrument of the present invention is referred to by reference numeral 10. Instrument 10 has a rounded top 12, a virtually flat bottom 14, a first end 16, which is preferably open, and a second end

18, preferably having a raised rim 20 and raised support ridges 22. Ridges 22 preferably include two or more, most preferably two, small apertures 24 therethrough.

Figure 3:
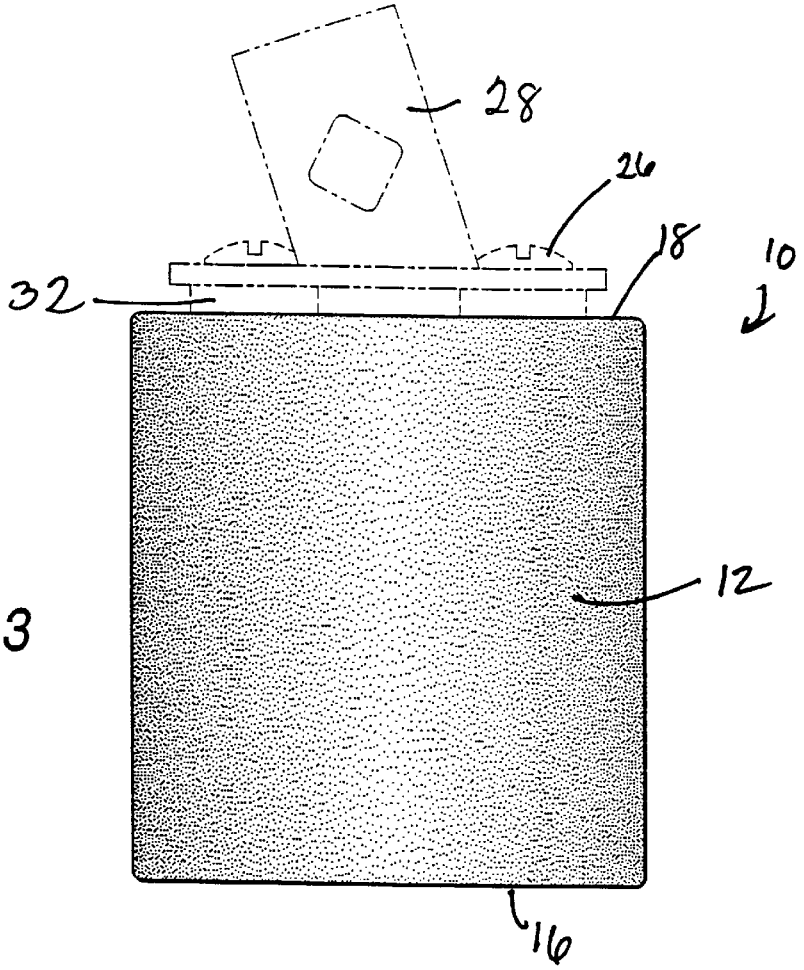
FIG. 3 is a top view of the instrument of FIG. 1, as assembled to include its mounting hardware.
Figure 4:
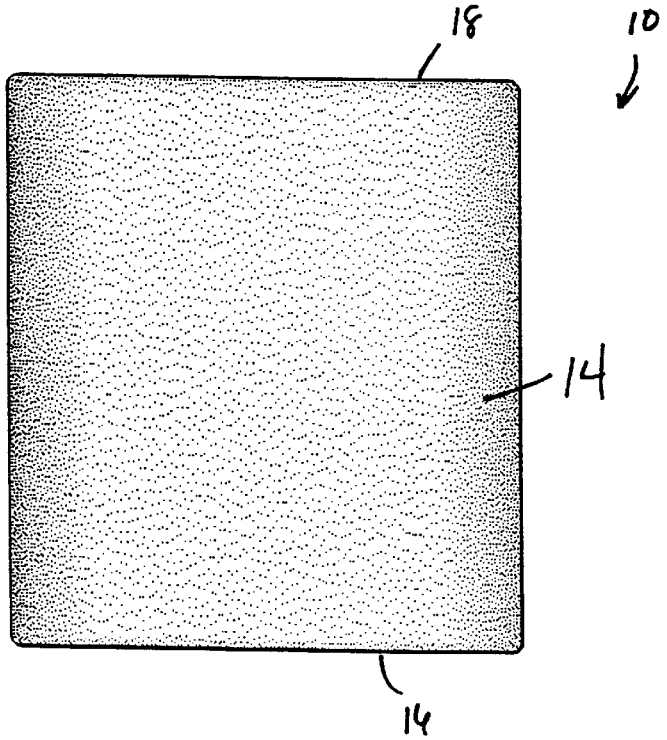
FIG. 4 is a bottom view of the instrument of FIG. 1.
Figure 5:
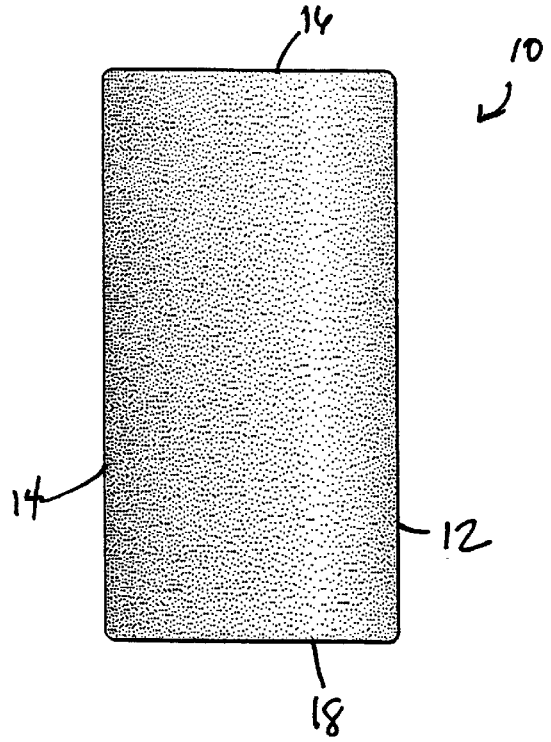
FIG. 5 is a first side view of the instrument of FIG. 1, wherein a second side view would be a mirror image thereof.
Figure 6:
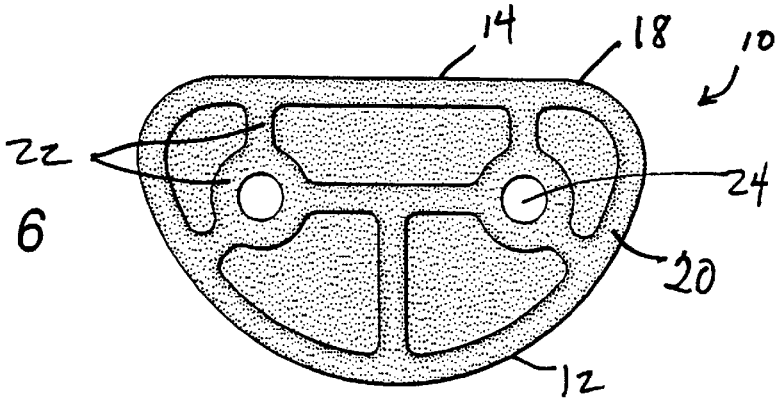
FIG. 6 is a first end view of the instrument of FIG. 1.
Figure 7:
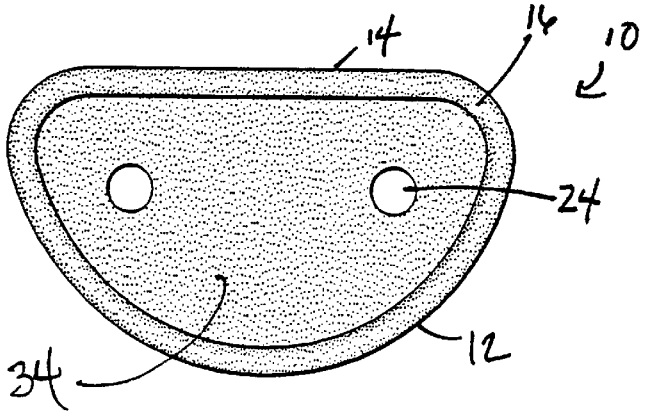
FIG. 7 is a second end view of the instrument of FIG. 1.

As shown in FIG. 3, this preferred instrument 10 further includes a pair of screws 26, preferably truss head screws, capable of attaching instrument 10 via apertures 24 in its second end 18 to a conventional eyebolt mount 28. This permits the instrument 10 to be affixed to a drum set, music holder, or other support, to place it in easy and stable reach of the musician. The screws 26 are preferably tightened onto the block instrument by means of elastic locknuts (not shown) and rubber washers 32. The use of two screws 26 is preferred to prohibit the block instrument from pivoting during use. Three or more apertures 24 can also be used in the second end 18 of instrument 10 without significantly affecting the sound.

The curvature of top 12 of the instrument 10 provides an inner chamber 34 having a unique semicircular cross-section. This chamber shape provides a pleasing sound quality, as well as an aesthetically appealing and easy-to-strike outer profile. In addition, by striking the instrument 10 in different places, different sounds can be produced.

The preferred dimensions of a first instrument 10 are as follows: 86 mm wide on the outside, 112.5 mm long, 100.5 mm long without including raised rim 20, 4 mm thick, 42 mm from the highest point of top 12 to bottom 14 within inner chamber 34, 40 mm between the respective centers of apertures 24, 20 mm along the shortest line from the outer surface of bottom 14 to the center of one of apertures 24, and 14 mm between the adjacent surfaces of the raised rim 20 along bottom 14 to the support ridge 22 connecting apertures 24.

A second preferred instrument 10 has the following dimensions: 76.4 mm wide on the outside, 82.5 mm long, 70.5 mm long without including raised rim 20, 4 mm thick, 36.5 mm from the highest point of top 12 to bottom 14 within inner chamber 34, 40 mm between the respective centers of apertures 24, 17.5 mm along the shortest line from the outer surface of bottom 14 to the center of one of apertures 24, and 11.5 mm between the adjacent surfaces of the raised rim 20 along bottom 14 to the support ridge 22 connecting apertures 24.

Other preferred angles and dimensions can be derived and interpolated from the figures based on the foregoing sets of preferred measurements. In addition, washers 32 are preferably 4 mm thick, 19 mm in diameter, and have a central aperture 9.5 mm in diameter. Screws 26 preferably have a shank 28 mm long. The locknuts used are preferably 12.5 mm across at the widest point, and 7.9 mm thick.

The body of instrument 10 is preferably formed from hard plastics such as ABS, fiberglass or acrylics such as Lexan. Most preferably, the body of the instrument 10 is a single piece injection molded from one or a combination of these materials, and most preferably, ABS.

Having thus described the present invention with particular references to the preferred forms thereof, it will be obvious that various changes and modifications may be made therein without departing from the spirit and scope of the present invention.

What is claimed is:

1. A percussion instrument comprising a hollow block, said hollow block having a first end, a second end, and a substantially semicircular cross-section along a length thereof between said first end and said second end.

2. The instrument of claim 1, wherein said first end is substantially open.

3. The instrument of claim 1, wherein said second end includes at least two mounting apertures.

4. The instrument of claim 3, further comprising at least two screws adapted to fit within said at least two mounting apertures.

5. The instrument of claim 4, wherein said at least two screws are truss head screws.

6. The instrument of claim 4, further comprising mounting means and tightening means selected from the group consisting of locknuts, washers and a combination of locknuts and washers, said tightening means and said at least two screws securing said mounting means to said hollow block.

7. The instrument of claim 1, wherein said second end includes a raised rim.

8. The instrument of claim 1, wherein said second end includes at least one raised support ridge.

9. The instrument of claim 1, wherein said body further includes a bottom that is generally flat.

10. The instrument of claim 1, wherein said body is made of a material selected from the group consisting of hard plastic, fiberglass, acrylic and a combination of hard plastic and fiberglass.

11. The instrument of claim 1, wherein said body is made of a material selected from the group consisting of ABS, Lexan and a combination of ABS and Lexan.

12. The instrument of claim 6, wherein said mounting means comprises an eyebolt mount.

13. The instrument of claim 1, wherein said body is a single injection molded piece.

* * * * *